US005566373A

United States Patent [19]

Seimetz et al.

[11] Patent Number: 5,566,373

[45] Date of Patent: Oct. 15, 1996

[54] PRESS APPARATUS

[75] Inventors: Hans-Georg Seimetz, Wadrill, Germany; Andrew R. Baker, Ross-on-Wye, England

[73] Assignee: Komage Gellner Maschinenfabrik GmbH, Kell, Germany

[21] Appl. No.: 307,740

[22] PCT Filed: Mar. 17, 1993

[86] PCT No.: PCT/GB93/00548

§ 371 Date: Sep. 26, 1994

§ 102(e) Date: Sep. 26, 1994

[87] PCT Pub. No.: WO93/18878

PCT Pub. Date: Sep. 30, 1993

[30] Foreign Application Priority Data

Mar. 25, 1992 [GB] United Kingdom ..... 9206526

[51] Int. Cl.[6] ..... B22F 3/02

[52] U.S. Cl. ..... 419/66; 419/61; 425/78; 425/352; 425/354

[58] Field of Search ..... 419/61, 66; 425/78, 425/352, 354

[56] References Cited

U.S. PATENT DOCUMENTS

| | | | |
|---|---|---|---|
| 3,733,154 | 5/1973 | Smith et al. | 425/78 |
| 4,000,231 | 12/1976 | Peterson | 264/40.2 |
| 4,325,734 | 4/1982 | Burrage et al. | 75/225 |
| 4,443,171 | 4/1984 | Dixon | 425/78 |
| 4,626,407 | 12/1986 | Veltri et al. | 419/18 |
| 5,043,123 | 8/1991 | Gormans et al. | 264/113 |
| 5,308,232 | 5/1994 | Merzhanov et al. | 425/79 |
| 5,401,153 | 3/1995 | Katagiri et al. | 425/78 |
| 5,409,662 | 4/1995 | Harai | 419/67 |
| 5,498,147 | 3/1996 | Katagiri | 425/78 |

FOREIGN PATENT DOCUMENTS

| | | | |
|---|---|---|---|
| 0224096 | 6/1987 | European Pat. Off. | B30B 11/02 |
| 4114880 | 11/1991 | Germany | B30B 1/26 |
| 2106275 | 4/1983 | United Kingdom | G05B 19/18 |
| 9002619 | 3/1990 | WIPO | B22F 3/02 |

*Primary Examiner*—Charles T. Jordan
*Assistant Examiner*—Daniel Jenkins
*Attorney, Agent, or Firm*—Synnestvedt & Lechner

[57] ABSTRACT

A method and apparatus for manufacturing a powder metallurgy article comprising two or more individually compacted layers is described. The apparatus includes a number of powder deposition means for depositing powder into at least one die cavity, the number of powder deposition means corresponding to at least the number of different powder compositions in an article being compacted, a die assembly having a female die body which is moveable with respect to a first press ram, a mechanically driven second press ram, means for driving said second press ram, control system means for controlling the relative positions and movements of said female die body, said first press ram, said second mechanically driven press ram and said powder deposition means such that they operate in synchronism, characterised by said control system means including an angle counter having proportional drive means from the press apparatus such that one cycle of the angle counter corresponds to a required number of press compaction strokes.

11 Claims, 5 Drawing Sheets

PRESS APPARATUS

The present invention relates to sintered materials, a method for their manufacture and to press apparatus for putting the method into effect.

Articles produced by a powder metallurgy route, and having two distinct layers, either prior to sintering or after sintering are known. U.S. Pat. No. 4,485,147 describes the manufacture of valve seat inserts for internal combustion engines. The valve seat inserts are made by providing two powder mixes; one mix being of a ferrous-based base powder and the second mix being of a copper-based material for the purpose of infiltration of the ferrous-based powder. A powder compaction die is first charged with a layer of the ferrous-based powder and then with a layer of the copper-based powder; the two layers being simultaneously compacted to form a green body having a relatively diffuse interface. The compacted green body is then sintered at a temperature to cause the copper-based layer to melt and infiltrate the ferrous-based layer. A significant problem with this method is that the interface between the two layers prior to sintering is necessarily diffuse and ill-defined, leading to poor surface quality in the final sintered product and necessitating the removal of relatively large quantities of metal by post-sintering machining operations. Other two-layer articles have also been proposed. EP-A-0 283 464 describes a rocker arm for the actuation of valves in an internal combustion engine. The rocker arm comprises a hard wear resistant material layer produced by powder compaction and sintering and having a body of a second ferrous-based powder compacted and sintered thereon. This article is produced by a two-stage process in that the hard wear resistant material layer is first made and then placed in a die to allow the body to be formed thereon. Special measures are employed in the provision of grooves or indentations in the pre-formed wear resistant layer to provide for mechanical keying to the subsequently compacted body.

EP-A-0 130 604 describes the manufacture of a two-layer valve seat insert for an internal combustion engine. The valve seat insert comprising two layers of different ferrous-based powders to provide specified physical and mechanical properties, the powders being individually compacted one upon the other and then sintered together.

Heretofore, powder compaction of such composite bodies has been by pressing on hydraulic presses. Hydraulic presses having die and press-ram movements governed by sophisticated microprocessor control systems have allowed complex pressing operations to be performed with relative ease. However, such presses and control systems are both expensive and slow in operation.

Purely mechanical presses are rapid in operation and relatively inexpensive, but heretofore have been relatively inflexible for the manufacture of the complex double layer type of article described above.

It is known to combine the advantages of controllability of hydraulic operation with the advantage of rapid press cycling of the mechanical press, by using a female die-body mounted on an axially moveable press matrix plate, the die-body and matrix plate being moveable relative to a fixed lower press ram, and a mechanically operated top press ram. In this hybrid press, the advantages of both hydraulic operation and mechanical operation may be combined.

It is an object of the present invention to provide a press apparatus having the versatility and controllability of a hydraulic press with the cycling rapidity of a mechanical press.

It is a further object of the present invention to provide a method for the manufacture of multi-layer articles by a powder metallurgy route, the method being more economic than known methods.

According to a first aspect of the present invention there is provided a method for the manufacture of an article by a powder metallurgy route, the article having at least two distinct, and separately compacted layers prior to any sintering operation, the method comprising the steps of sequentially depositing metal powder into a die cavity, synchronously controlling said powder deposition and powder compaction means for compacting said powders in said die cavity wherein there is at least one intermediate compaction stroke of at least one powder layer prior to a final compaction stroke before ejection of the article from said die, and further wherein powder compaction means includes at least one mechanically driven ram.

The sequences of depositing powder into the die cavity and compaction of the powder may be varied. For example, powder of one chemical composition may be deposited in the die cavity followed by compaction thereof and subsequently followed by powder of a second composition which is then compacted on top of the first powder. Alternatively, one powder layer may be deposited in the die cavity followed by a second powder layer which two layers are both then compacted simultaneously. In the former case, a well defined interface is formed between the two layers, and is the type of interface which is desirable where the second powder layer is, for example, of a copper-based infiltrant material so that a well defined surface remains after the sintering operation. In the latter case, a more diffuse, less well defined interface is formed, and is the type of interface which is desirable from the point of view of mechanical bond strength and integrity between the two layers in a structural part.

Various modifications may be employed in parts having multiple layers. For example, an article may have more than two layers and may have interfaces of both types described above. Specifically, an as-pressed green body may have, for example, two ferrous-based layers having a diffuse type of interface for mechanical strength reasons, and a planar type interface formed by an intermediate compaction stroke where a third layer is intended to be a copper-based infiltrant material.

The articles under consideration are not limited to having metal layers only, and articles including layers selected from ceramics, chemicals or other non-metallic materials in addition too or instead of metallic layers are also envisaged.

Compaction of articles may also be sequentially staged with regard to the degree of compaction applied at any given stage. For example, a first powder deposited in a die may be only very lightly compacted prior to depositing a second powder layer and given a final compaction stroke which effectively compacts both powder layers simultaneously, the first light compaction stroke serving essentially to produce a more well defined interface between the different powder layers or regions.

According to a second aspect of the present invention there is provided press apparatus, the apparatus including a number of powder deposition means for depositing powder into at least one die cavity, the number of powder deposition means corresponding to at least the number of different powder compositions in an article being compacted, a die assembly having a female die body which is moveable with respect to a first press ram, a mechanically driven second press ram, means for driving said second press ram, control system means for controlling the relative positions and movements of said female die body, said first press ram, said second mechanically driven press ram and said powder deposition means such that they operate in synchronism, said control system means including an angle counter having proportional drive means from the press apparatus such that one cycle of the angle counter corresponds to a required number of press compaction strokes.

The control system may be a computer based control system having a software program which has distinct control command sequences for each different article to be made.

The means for driving said second press ram may be an electric motor driving the second press ram through a known drive chain of belts and gears to an eccentric which imparts movement to the second press ram, for example. The rotational movements of the electric drive motor are controlled by the control system means, the rotational positions of the driven eccentric being monitored by the angle counter which imparts signals to the computer control system indicative of the rotational or angular position of the eccentric which is of itself indicative of the position of the second press ram. The angle counter sends signals to the computer control system indicative of the stage of the cycle during the pressing of one article. The angle counter sends signals to the computer control system which then sends control signals to the drive motor. The control signals provided from the computer program also govern the hydraulic system through a system of electrically controlled valves which determine the movements and position of the die body which is mounted to the press matrix. The powder deposition means are also controlled by the computer program in that the powder is deposited in the die cavity at the appropriate time in response to the signals being produced by the angle counter which is being driven from the second press ram position controlling eccentric.

The powder deposition means may comprise powder shoes which may be driven hydraulically, pneumatically or electrically for example, the shoes moving in response to the signals from the computer program which is in turn triggered by the positional signals from the angle counter, to deposit powder in the die cavity. The powder deposition means refers only to the means used for depositing powder into the die cavity. Where a known type of powder shoe is used, it may be divided up into two or more compartments for powders of different compositions. Other associated equipment will also be employed as is known in the art, such equipment including powder hoppers for keeping the powder deposition means supplied with powder for production runs.

According to a third aspect of the present invention there are provided articles when made by the method or by the apparatus of the first and second aspects of the present invention.

In order that the present invention may be more fully understood, an example will now be described by way of illustration only with reference to the accompanying drawings, of which:

Figure 1:
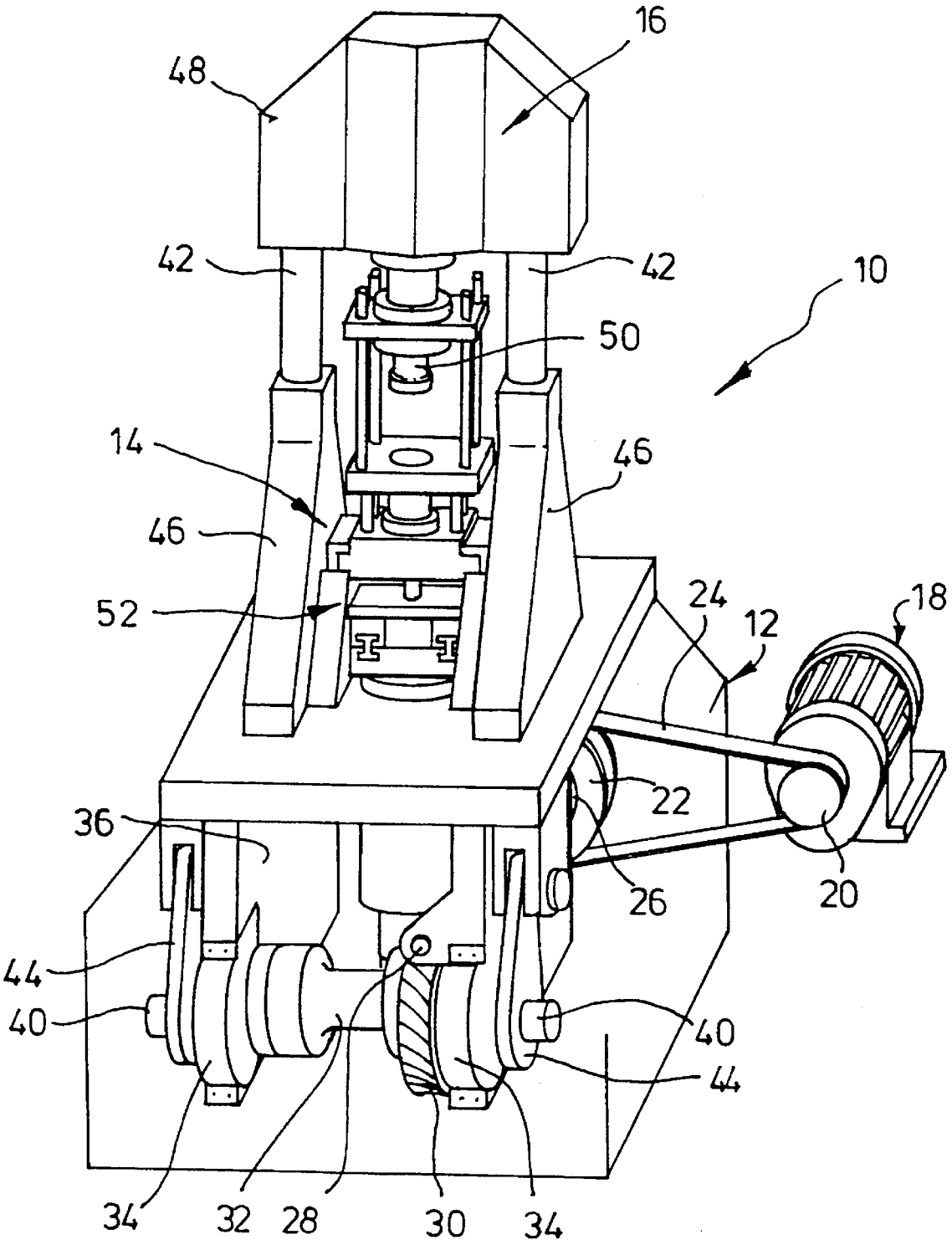
FIG. 1 shows a perspective view of press apparatus according to the present invention.
Figure 2:
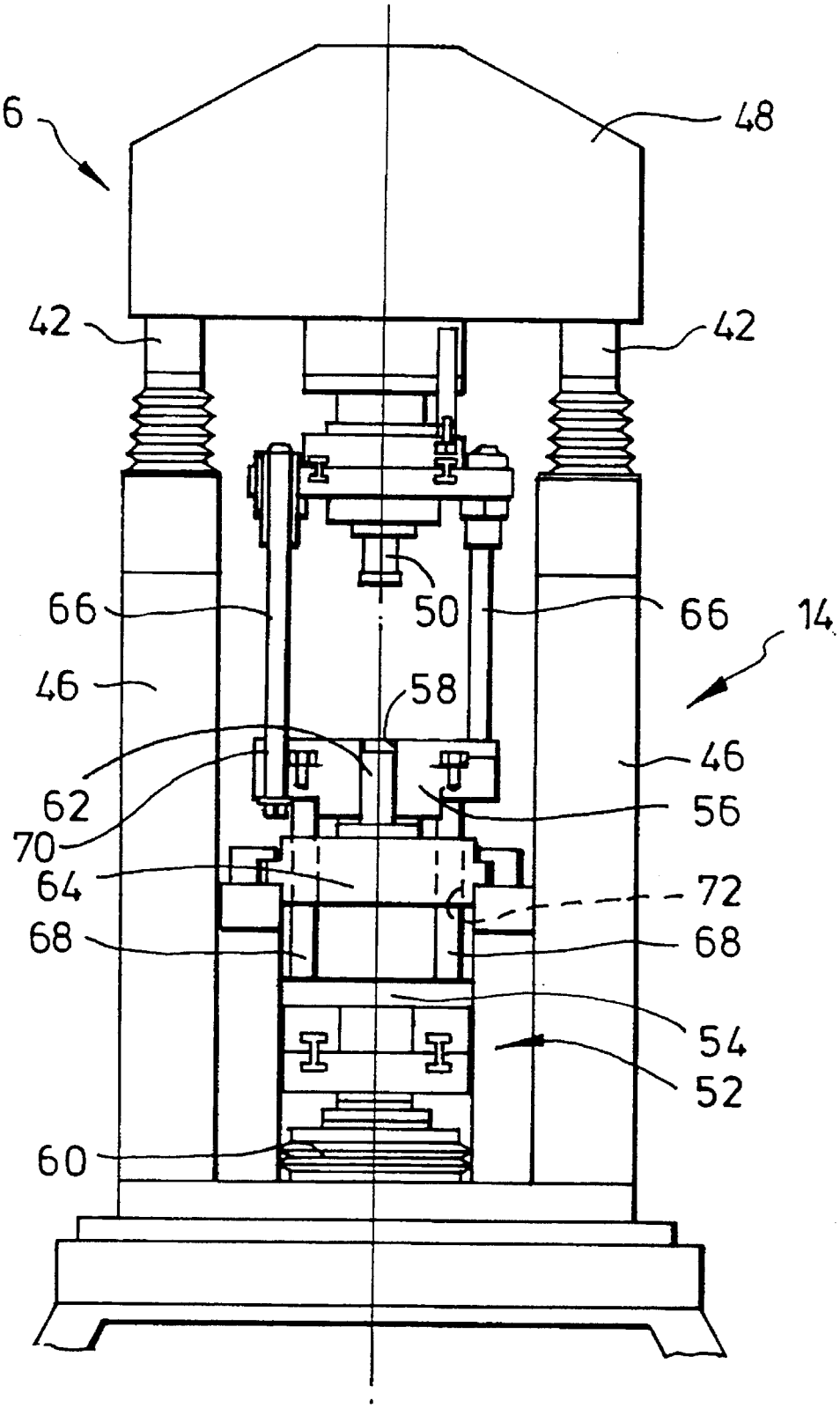
FIG. 2 shows a view in elevation of the matrix and die arrangement of the press apparatus of FIG. 1.

Referring now to FIGS. 1 to 4, and where the same features are denoted by common reference numerals.

FIG. 1 shows a perspective view of a press which is indicated generally at 10. The press comprises a base unit 12, shown partly cut away, which houses the operating means for a moveable press ram and which will be described in detail below; a centre section 14 housing the press matrix and die; and a moveable press crosshead assembly 16. The press crosshead assembly 16 is operated by a mechanical arrangement in the base unit 12 which in turn is driven by an electric motor 18 which is controlled by a control system which will be described in detail with reference to FIG. 5. A motor pulley 20 is connected to a second pulley 22 by a drive belt 24. The pulley 22 is fixed to a shaft 26 which has a worm gear 28 at one end, the worm gear 28 engaging with a toothed gear wheel 30 which is fixed to a shaft 32 having an axis transverse to the shaft 26. The shaft 32 runs in bearing blocks 34 fixed to rigid housings 36. The shaft 32 has a pair of eccentrically mounted drive pins 40. Rotary motion of the shaft 32 is transmitted to pair of slidable columns 42 by connecting rods 44; the slidable columns 42 moving in vertical press frame housings 46. The upper ends of the two columns 42 are linked by a transverse crosshead member 48 to which is attached a press ram 50 and which is constrained to move in the vertical direction by virtue of the housings 46. The press matrix/die assembly, indicated generally at 52, is sited between the two press frame housings 46 in the press centre section 14. The matrix 52 is hydraulically controlled and comprises a moveable horizontal plate member 54 to which is mounted a female die body 56 having a die cavity 58, and the components of which die are positionally controllable in the vertical direction by hydraulic valves (not shown) actuating a hydraulic cylinder 60, the valves themselves being operated by the control system which will be described in greater detail below. A fixed lower press ram 62 is situated on a fixed plate 64 mounted between the housings 46. The upper ram 50, die body 58 and lower fixed ram 62 are constrained to move in accurate axial alignment by slide pins 66 and 68 moving in guide conduits 70 and 72 in the die body 56 and mounting plate 64, respectively. The press matrix is more clearly illustrated in FIG. 2 which shows a side view of this section of the press and the crosshead assembly 16. To operate the press, other facilities such as powder deposition shoes (not shown) which may be hydraulically, pneumatically or electrically operated under the control of the control system are required for die filling, but have been omitted for the sake of clarity.

Figure 3:
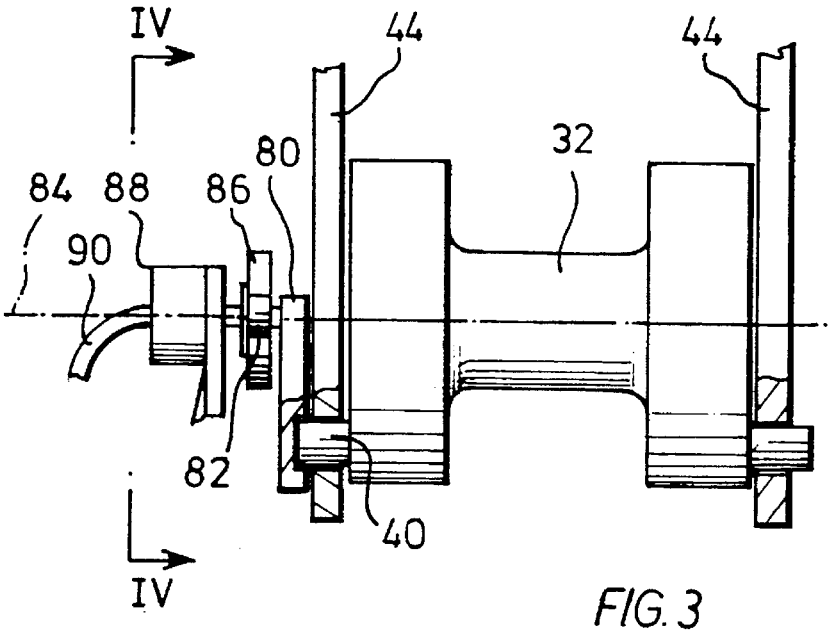
FIG. 3 shows a schematic elevation view of part of the control system of the press apparatus of FIG. 1.
Figure 4B:
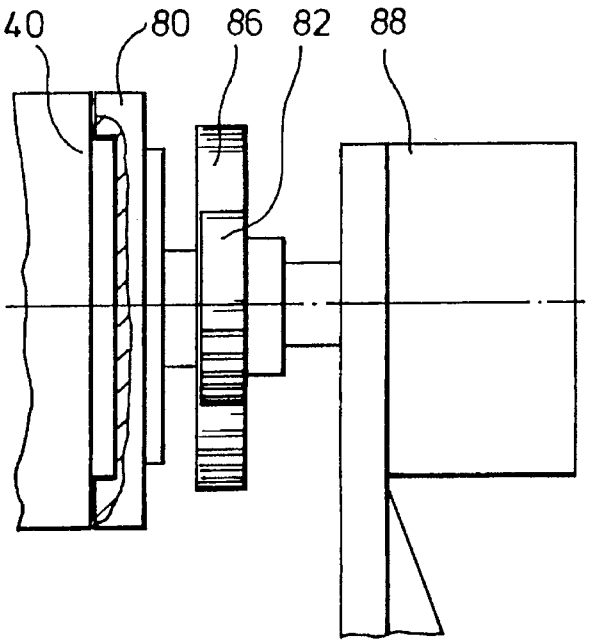
FIGS. 4A and 4B show a cross section (and corresponding side view) through the plane IV—IV of FIG. 3.
Figure 4B:
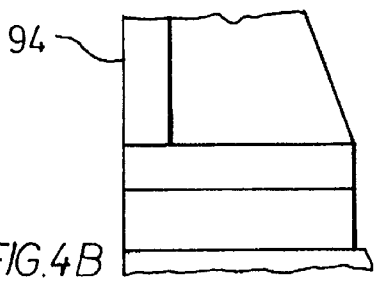
Figure 4A:
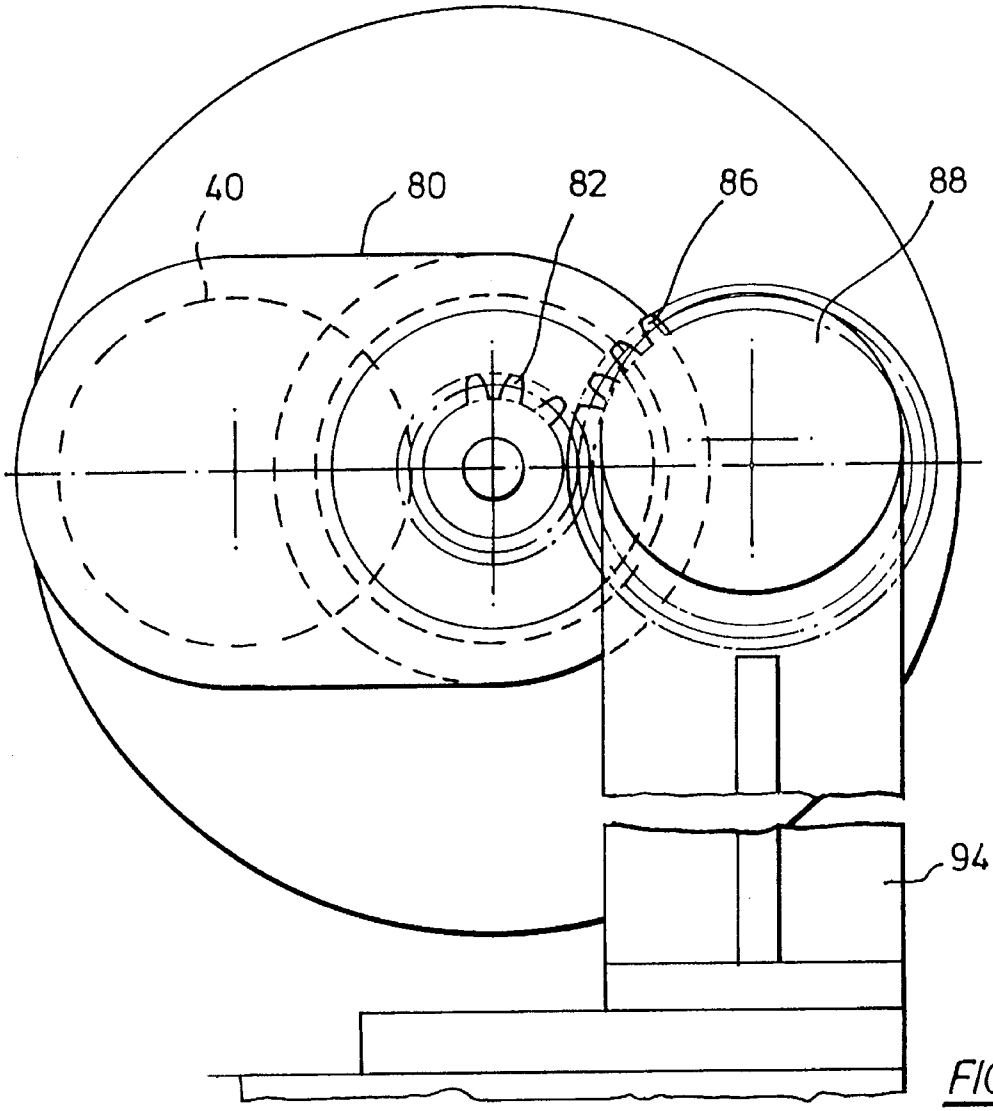

On the end of one of the eccentrics as shown in FIGS. 3 and 4 (but omitted from FIG. 1 for the sake of clarity) is an arm 80 on which a pinion gear wheel 82 is fixedly mounted and which gear is coaxial with the axis 84 of the shaft 32. On rotation of the shaft 32 the gear 82 drives a second, larger gear wheel 86 which is fixed to the shaft of an angle counter 88 which is electrically connected 90 to an angular position decoding unit 104 of the control system which will be described in detail below. The angle counter 88 is fixedly mounted on a bracket 94 (see FIG. 4). The relative ratios of gears 82 and 86 will depend upon the article being compacted in the die assembly of the press. For example, if an article having two separately compacted layers is to be produced, the gear ratio will be 1:2, i.e. two complete revolutions of the shaft 32 (and gear pinion 82) will effect one complete revolution of the gear wheel 86 and hence the shaft of the angle counter 88. Similarly, if the article being compacted has three separately compacted layers, the ratio between gears 82 and 86 will be 1:3, and for four layers, 1:4.

Figure 5:
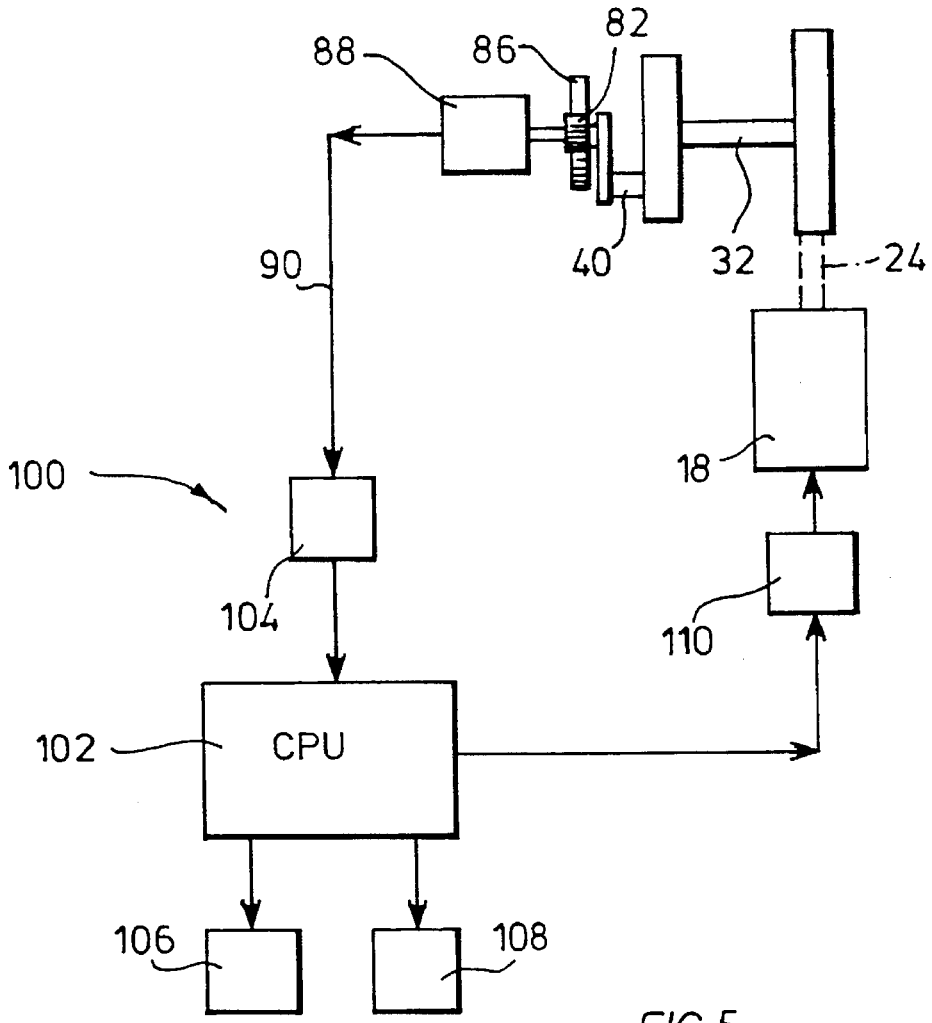
FIG. 5 shows a schematic diagram of the control system according to the present invention.

The control system, indicated schematically at 100 in FIG. 5, comprises a computer central processing unit 102 which contains a control program unique to the actual article being made on the press. As described above, the motor 18 drives the shaft 32 and consequently the angle counter 88 through the gears 82 and 86: the output from the angle counter 88 is passed to an angular position decoder 104 which then supplies this information to the computer central processing unit 102. The central processing unit, depending upon the information received from the angular position decoder 104, then transmits signals to control units 106 and 108 which control the die powder filling equipment and the electrically controlled hydraulic valves controlling the press matrix/die assembly 52, as appropriate. Control signals are also provided to the motor 18 through a motor control unit and power pack 110 in accordance with the requirements for the particular article being made and contained in the control program in the central processing unit 102. Therefore, in one 360 degree revolution of the angle counter 88, all the information necessary for the manufacture of the article being made is contained in the program in the central processing unit 102.

Figure 6B:
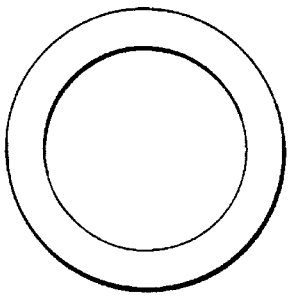
FIGS. 6A and 6B show a plan and elevation view of an article made by the method and press apparatus of the present invention.
Figure 6A:
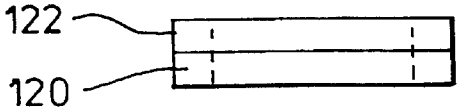

The operation of the press and control system will now be described with respect to the manufacture of a ring-shaped article having two layers, each layer being successively compacted. The actual die construction will not be described in detail as this will already be known and understood by those skilled in the art. Reference is made to FIG. 6 which shows a side (FIG. 6A) and plan (FIG. 6B) view of the article being produced. The article comprises two layers 120 and 122 of two different ferrous powder compositions, for example. Ejection of the previous article made by suitable movement of the die components by the hydraulic system under control through the unit 106 which receives control signals from the central processor 102 is effected as the top ram 50 is withdrawn from the die cavity 58. As the top ram 50 retracts, the die cavity 58 is filled with powder of composition corresponding to the layer 120 from a compartment in a powder distribution shoe (not shown) under control from the unit 108, these control signals in the central processing unit 102 corresponding to the rotation of the angle counter as the ram 50 retracts. Further rotation of the angle counter caused by rotation of the shaft 32 and the ram 50 descending on the first compaction stroke also results in suitable movement of the die components under hydraulic control from the unit 106, to allow the first powder layer 120 to be compacted in the appropriate part of the die cavity 58. As the ram 50 retracts after the first compaction stroke, the second layer of powder 122 is deposited in the die cavity above the first, now compacted, layer 120. Further rotation of the angle counter, caused by the shaft 32 and the ram 50 descending on its second compaction stroke, results in the unit 106 making appropriate movements of the die components as the second layer 122 of powder is compacted. Retraction of the ram 50 from the die cavity 58 causes ejection of the pressed part by virtue of the instructions to the unit 106 from the central processing unit 102 in response to the output from the angle counter. The cycle then continues with the manufacture of the succeeding article by repetition of the above cycle of operations.

The above two layer article was made during two complete revolutions of the press to effect two compaction strokes of the ram 50. These two press revolutions caused one complete revolution of the angle counter 88 to effect one set of instructions from the central processing unit 102 in order to manufacture one article. Similarly, if the article being made comprised three separately compacted layers, then three separate compaction strokes of the ram 50 would be required to effect one revolution of the angle counter 88, thus a ratio of 1:3 between the gears 82 and 86 would be required.

Figure 7:
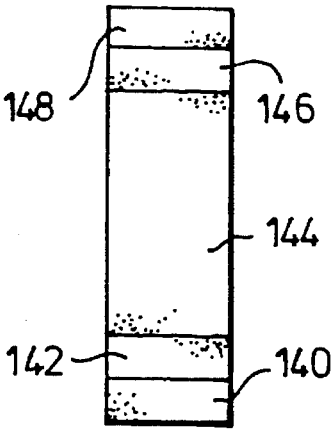
FIG. 7 which shows a cross section through a second article made by the method and press apparatus of the present invention.

The ratio between the gears 82 and 86 is governed by the number of separate compaction strokes required by the top ram 50, and not necessarily by the number of powder layers per se. For example, an article having five separate powder layers as shown in FIG. 7 would necessitate three separate compaction strokes because the layers 142, 144 and 146 are deposited without intermediate compaction strokes. Compaction strokes occur after deposition of the layers 140, 146 and 148, the interfaces between the layers 142, 144 and 144, 146 being diffuse interfaces for the purpose of generating maximum interfacial bond strength. The ratio between the gears 82 and 86 would be 1:3 in this case. In the article shown in FIG. 7, the layers 142, 144 and 146 may be ferrous-based powders, 142 and 146 being the same, whilst layers 140 and 148 may be, for example, layers of copper-based infiltrant material.

In addition to purely positional information, the program in the central processing unit 102 may contain control instructions relating to the speed of rotation of the drive motor 18 thus, for example, allowing for a relatively slow rotational speed and hence a relatively low upper ram 50 velocity in order to provide sufficient time for the die filling operations, for example, to be performed at the appropriate stage of the manufacturing cycle.

The angle counter 88 may be driven by any suitable arrangement whereby the appropriate ratio between compaction strokes and a full cycle of the angle counter may be achieved. Alternatives to direct gear drives 82, 86 may include gear wheels driving a chain, gears and a toothed belt, pulleys and a belt, for example.

Examples of articles which may be manufactured by the method and apparatus of the present invention may include cams, guides, bushes, friction plates, structural parts and many other articles commonly made by a powder metallurgy route.

We claim:

1. A method for the manufacture of an article by a powder metallurgy route, the article having at least two distinct, and separately compacted layers prior to any sintering operation, the method comprising the steps of sequentially depositing metal powder into a die cavity, synchronously controlling said powder deposition and powder compaction means for compacting said powders in said die cavity, said compaction of said powder being by compaction at each axial end of said article by a lower press ram and an upper mechanically actuated ram, said lower press ram and said upper ram both moving relative to a die body which is positionally controlled by hydraulic valve control means, wherein there is at least one intermediate compaction stroke of at least one powder layer prior to a final die powder filling step and a final compaction stroke before ejection of the article from said die, wherein each compaction stroke of said upper mechanically driven ram corresponds to one full 360° revolution cycle of a mechanical press apparatus; a total number of full 360° press revolution cycles corresponding to one 360° cycle of an angle counter in a control system for sad press apparatus.

2. A method according to claim 1 wherein the degree of compaction at the at least one intermediate compaction stroke is controlled by appropriate movements of said die body and said lower ram in response to a required decree of compaction.

3. Press apparatus, the apparatus including a number of powder deposition means for depositing powder into at least one die cavity, the number of powder deposition means corresponding to at least the number of different powder compositions in an article being compacted, a die assembly having a female die body which is moveable with respect to a first press ram, a mechanically driven second press ram, means for driving said second press ram, control system means for controlling the relative positions and movements of said female die body, said first press ram, said second mechanically driven press ram and said powder deposition means such that said first press ram, said second mechanically driven press ram and said powder deposition means operate in synchronism, wherein said control system means includes an angle counter, said angle counter being driven by said driving means for said second press ram; there being interposed between said driving means and said angle counter proportional reduction drive means such that one 360° C. cycle of the angle counter corresponds to a required number of press cycles and compaction strokes of said second mechanically driven press ram.

4. Press apparatus according to claim 3 wherein said control system includes a computer having a program having control command sequences for each different article made.

5. Press apparatus according to claim 3 wherein there are two press compaction strokes of said second ram and said proportional reduction drive to said angle counter is in ratio of 1:2, said driving means rotating through two full revolutions to each revolution of said angle counter.

6. Press apparatus according to claim 3 wherein there are three press compaction strokes of said second ram and proportional reduction drive to said angle counter is in a ratio of 1:3, said driving means rotating through three full revolutions to each revolution of said angle counter.

7. Press apparatus according to claim 3 wherein the proportional reduction drive means is a gear drive.

8. Press apparatus according to claim 3 wherein said first press ram is in a fixed position with respect to said press.

9. Press apparatus according to claim 3 further including an electric motor for driving said press ram in response to control signals from said control system means through a mechanical drive linkage.

10. Press apparatus according to claim 9 wherein rotational movements and speed of said electric motor is controlled by said control system means.

11. Press apparatus according to claim 3 wherein said required number of press compaction strokes is related to the number of separately compacted powder layers in said article being compacted.

* * * * *

UNITED STATES PATENT AND TRADEMARK OFFICE

CERTIFICATE OF CORRECTION

PATENT NO. : 5,566,373

DATED : October 15, 1996

INVENTOR(S) : Seimetz et al

It is certified that error appears in the above-indentified patent and that said Letters Patent is hereby corrected as shown below:

Column 1, line 25, start new paragraph with "Other two-layer"

Column 6, line 60, change "sad" to --said--

Column 6, line 65, change "decree" to --degree--

Column 7, line 18, delete "C."

Column 7, line 22, before "program" insert --software--

Column 8, line 1, before "ratio" insert --a--

Column 8, line 6, before "proportional" insert --said--

Signed and Sealed this

Eighth Day of July, 1997

Bruce Lehman

*Attest:*

BRUCE LEHMAN

*Attesting Officer*

*Commissioner of Patents and Trademarks*